US008406930B2

(12) United States Patent
Blackshaw et al.

(10) Patent No.: US 8,406,930 B2
(45) Date of Patent: Mar. 26, 2013

(54) SYSTEM AND METHOD FOR OPERATING AN ECONOMIZER CYCLE OF AN AIR CONDITIONER

(75) Inventors: Andrew L. Blackshaw, Dunwoody, GA (US); Michael D. Whitehurst, Cordele, GA (US); Paul Franklin Fay, Cordele, GA (US); Jeff Dewitt Brown, Vienna, GA (US)

(73) Assignee: Airxcel, Inc., Wichita, KS (US)

( * ) Notice: Subject to any disclaimer, the term of this patent is extended or adjusted under 35 U.S.C. 154(b) by 363 days.

(21) Appl. No.: 12/879,806

(22) Filed: Sep. 10, 2010

(65) Prior Publication Data

US 2012/0065795 A1 Mar. 15, 2012

(51) Int. Cl.

| | |
|---|---|
| ***G01M 1/38*** | (2006.01) |
| ***G05D 3/12*** | (2006.01) |
| ***F25D 17/06*** | (2006.01) |
| ***F25D 17/04*** | (2006.01) |
| ***F25B 1/00*** | (2006.01) |

(52) U.S. Cl. ..... 700/278; 700/295; 700/300; 62/89; 62/187; 62/498

(58) Field of Classification Search ..... 700/276–278, 700/295, 300; 62/89, 187, 498
See application file for complete search history.

(56) References Cited

U.S. PATENT DOCUMENTS

| | | | | |
|---|---|---|---|---|
| 3,896,634 | A * | 7/1975 | Nagele et al. | 62/408 |
| 8,102,066 | B2 * | 1/2012 | Hashimoto et al. | 290/40 C |
| 8,140,195 | B2 * | 3/2012 | Matteson et al. | 700/299 |
| 2011/0130881 | A1 * | 6/2011 | Nanami | 700/277 |

OTHER PUBLICATIONS

"Air Conditioning 101". Posted Date: Unknown; Printed Date: Aug. 10, 2010; <http://livingwithmyhome.com/101-home-tips/air-conditioning.aspx>.

Muller, Dr. Michael R., Michael Simek, Jennifer Mak, and Bojan Mitrovic. "Modern Industrial Assessments a Training Manual Version 2.0." Original Version: Dec. 1995; Updated Version: Sep. 2001; The State University of New Jersey Rutgers.

Wang, Gang, Zhan Wang, Ke Xu, and Mingsheng Liu. "Air Handling Unit Supply Air Temperature Optimization during Economizer Cycles." Date: Dec. 1, 2007; University of Nebraska—Lincoln.

* cited by examiner

*Primary Examiner* — Sean Shechtman
(74) *Attorney, Agent, or Firm* — Hovey Williams LLP

(57) ABSTRACT

An air conditioning system for cooling an enclosure includes an air conditioner and a control system for triggering an economizer cycle of the air conditioner. The control system determines an electrical load of equipment in the enclosure, calculates a maximum acceptable outdoor temperature at which the economizer cycle may be operated based at least partially on the electrical load, receives data representative of an actual outdoor temperature, and initiates the economizer cycle if the actual outdoor temperature is equal to or below the maximum acceptable outdoor temperature.

18 Claims, 4 Drawing Sheets

SYSTEM AND METHOD FOR OPERATING AN ECONOMIZER CYCLE OF AN AIR CONDITIONER

BACKGROUND

Many air conditioners include economizer cycles to reduce energy use when the outside air is cool and dry enough to provide required system cooling. During an economizer cycle, an air conditioner's mechanical refrigeration equipment is turned off, cool outside air is introduced into the enclosure served by the air conditioner, and warmer inside air is exhausted from the enclosure. An economizer cycle uses significantly less energy than a refrigeration cycle because it only requires operation of a relatively low power blower.

Air conditioners typically switch between their economizer cycles and conventional refrigeration cycles by measuring an outdoor dry bulb (DB) temperature, comparing the DB temperature to a target temperature, and switching to an economizer cycle if the outdoor air temperature is below the target. For example, many air conditioners trigger their economizer cycles when outdoor temperatures are at or below a supply air temperature setpoint, which is typically within the range of 55°-59° F.

Another method to switch between refrigeration and economizer cycles senses outdoor and return air enthalpy and switches to the economizer cycle whenever the outdoor air enthalpy is less than that of the return air.

SUMMARY

Applicants have discovered that switching between economizer and refrigeration cycles based on outdoor temperature and/or enthalpy levels alone often results in under-utilization of the economizer cycle and therefore unrealized energy savings. Embodiments of the present invention address this problem and provide a distinct advance in the art of air conditioners and economizer control systems by providing an improved system and method for operating an air conditioner economizer cycle.

An exemplary embodiment of the present invention is an air conditioning system that serves an enclosure and that broadly comprises an air conditioner and a control system for controlling operation of the air conditioner. The control system monitors an electrical load of equipment in the enclosure, which for substantially sealed enclosures with no occupying personnel is representative of the internal heat gain in the enclosure. The control system then calculates a maximum acceptable outdoor temperature at which the economizer cycle can be operated based at least partially on the electrical load. The control system then receives data representative of an actual outdoor temperature and initiates the economizer cycle if the actual outdoor temperature is equal to or below the maximum acceptable outdoor temperature. The control system may also determine and consider the heat loss from the enclosure when calculating the maximum acceptable outdoor temperature and may measure the humidity of the outside air, calculate its dew point, and compare it to a dew point threshold before switching to the economizer cycle. The outside air dew point may also be measured directly with a dew point sensor.

Another exemplary embodiment of the technology is a method of operating an air conditioner comprising the steps of: monitoring an electrical load of equipment in the enclosure; calculating a maximum acceptable outdoor temperature at which an economizer cycle may be operated based at least partially on the electrical load; measuring an actual outdoor temperature; and initiating the air conditioner's economizer cycle if the actual outdoor temperature is equal to or below the maximum acceptable outdoor temperature.

These and other embodiments of the invention described below provide numerous advantages over prior art methods of initiating air conditioner economizer cycles. For example, by considering both the outdoor temperature and an enclosure's internal heat gain when determining when to initiate an economizer cycle, the control system of the present invention can often initiate an economizer cycle at higher outdoor temperatures, thus improving the efficiency of the air conditioner. Moreover, by monitoring the electrical load of the equipment in the enclosure to determine the enclosure's internal heat gain, the control system can quickly and easily calculate the maximum temperature at which the economizer cycle may be operated and can likewise quickly and easily update the calculated maximum temperature as the load changes.

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
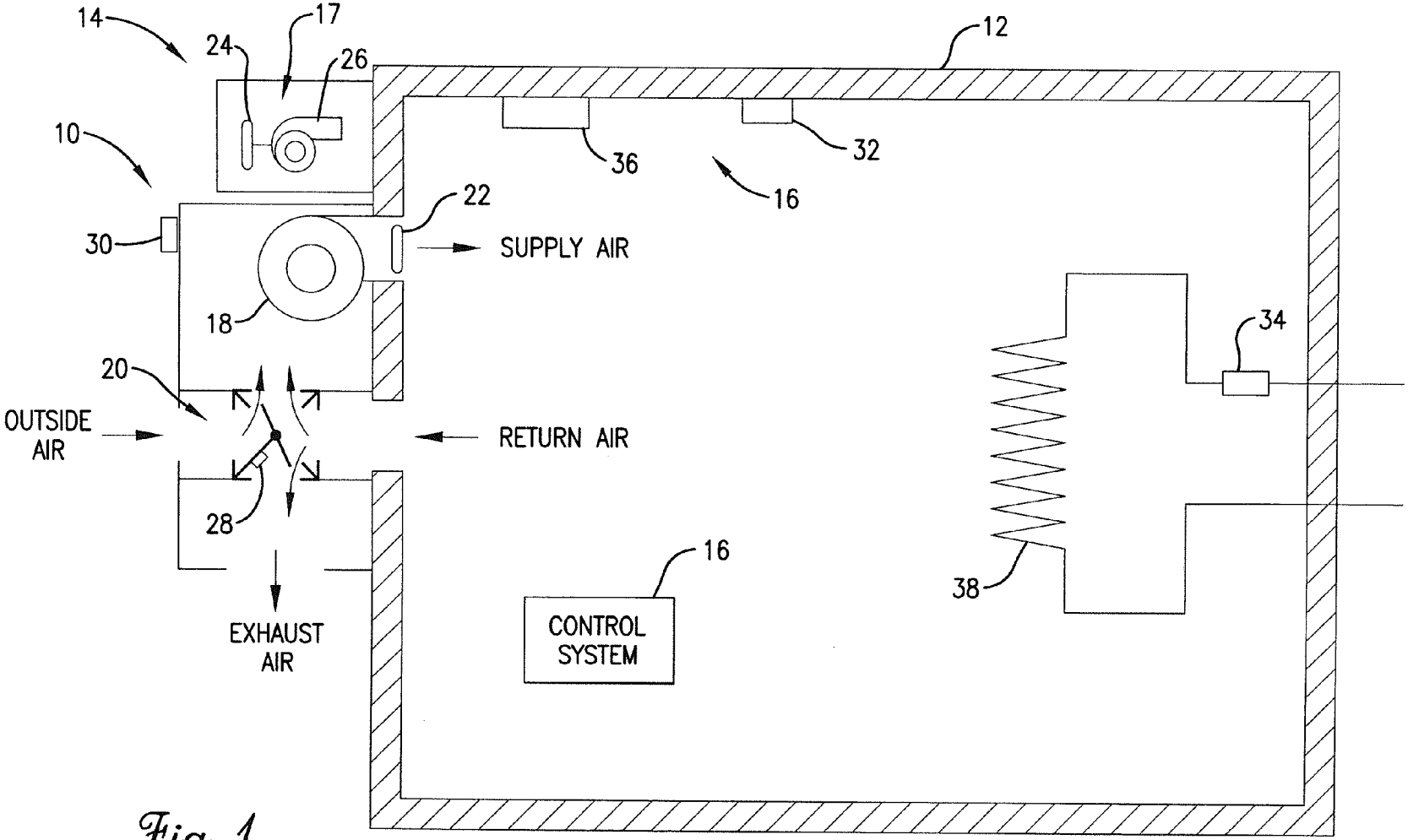
FIG. 1 is a schematic diagram of an exemplary air conditioning system and an enclosure that may be used to implement the principles of the present technology.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of embodiments of the invention references the accompanying drawings. The embodiments are intended to describe aspects of the invention in sufficient detail to enable those skilled in the art to practice the invention. Other embodiments can be utilized and changes can be made without departing from the scope of the claims. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Turning now to the drawing figures, and particularly FIG. 1, an exemplary air conditioning system 10 that may be used to implement principles of the present invention is shown providing cooling to an exemplary enclosure 12. The air conditioning system 10 and enclosure 12 described and illustrated herein, as well as their constituent components, are merely examples of equipment and components that may be utilized to implement the principles of the invention and may be replaced with other equipment and/or components without departing from the scope of the appended claims.

An embodiment of the air conditioning system 10 broadly comprises an air conditioner generally referred to by the numeral 14 for cooling the enclosure 12 and a control system generally referred to by the numeral 16 for controlling operation of the air conditioner 14. The enclosure 12 may be a building, a room in a building, a shed, a cabinet, or any other substantially enclosed structure. Applicants have discovered that the principles of the present invention are especially useful for substantially sealed enclosures that are infrequently occupied by people. Thus, in one particular embodiment, the enclosure 12 is a cabinet such as those used to house telecommunications equipment.

In more detail, an embodiment of the air conditioner 14 broadly comprises a refrigeration system 17, a blower 18, and a damper 20. The refrigeration system 17 is conventional and includes an evaporator coil 22 positioned in the air flow path of the blower 18, a condenser coil 24 positioned in a cabinet outside the enclosure 12, and a compressor pump 26 for pumping refrigerant gas between the evaporator coil 22 and the condenser coil 24. The refrigeration system 17 may be of any size or rating depending on the size of the enclosure 12, the climate in which the enclosure 12 is placed, and the type and size of the equipment in the enclosure 12.

The blower 18 is also conventional and may be a stand-alone unit or may be integrated in an air handler that is connected to a duct system for delivering air to various locations within the enclosure 12. As depicted in FIG. 1, air exiting the blower 18 and passing over the evaporator coil 22 is referred to herein as "supply air." air exiting the enclosure 12 and recirculated to the inlet of the blower 18 is referred to herein as "return air," air exiting the enclosure 12 entirely is referred to herein as "exhaust air," and air from outside the enclosure 12 that is directed toward the inlet of the blower 18 is referred to herein as "outside air."

The damper 20 is also conventional and is positioned near the inlet of the blower 18 or the air handler in which the blower 18 is mounted and is provided for controlling the amount of outside air and return air delivered to the inlet of the blower 18 as well as the amount of exhaust air expelled from the enclosure 12. The damper 20 may be positioned by a motorized actuator 28 that is in turn controlled by the control system 16 as explained in more detail below.

In one embodiment, the damper 20 is a single unit that simultaneously controls the flow of outside air and return air to the blower 18 and the flow of exhaust air from the enclosure 12. For example, in one terminal position, the damper 20 prevents any outside air from entering the blower 18, prevents any exhaust air from leaving the enclosure 12, and directs all of the return air to the blower 18. In an opposite terminal position, the damper 20 only directs outside air to the blower 18 and prevents any return air from entering the blower 18 and instead exhausts it from the enclosure 12 as exhaust air. Intermediate positions of the damper 20 deliver a mix of outside air and return air to the blower 18 and permit some but not all of the return air to be exhausted from the enclosure 12. In other embodiments, separate controllable dampers may be provided for the return air, outside air, and exhaust air.

The control system 16 controls operation of air conditioner 14 to perform the functions described herein and in one embodiment includes an exterior temperature and humidity sensor 30, an interior temperature sensor 32, an electrical load sensor 34, and a controller 36 for receiving data from and/or controlling operation of the other components of the air conditioning system 10.

The exterior temperature and humidity sensor 30 is conventional and is provided for measuring or sensing the air temperature and humidity outside the enclosure 12. The exterior temperature and humidity sensor 30 may also directly measure the outside air dew point rather than just measure the humidity. Outside air temperatures and humidity levels may also be received from other sources such as a radio weather station. Similarly, the interior temperature sensor 32 is also conventional and is provided for measuring or sensing the air temperature inside the enclosure 12. The interior temperature sensor 32 may be a stand-alone temperature sensor or it may be integrated in the controller 36. Inside air temperatures may also be received from other sources such as thermostats or temperature sensors provided with other equipment or systems in the enclosure 12.

The electrical load sensor 34 senses or otherwise detects the electrical load of equipment 38 in the enclosure 12. The equipment 38 may be any equipment or device powered by AC or DC electricity. In one embodiment, the equipment 38 includes DC powered telecommunications switches, routers, and/or repeaters. Thus, in one embodiment, the load sensor is a DC current transmitter that detects the DC current drawn by the equipment 38.

The controller 36 receives measured data from the temperature and humidity sensor 30, the interior temperature sensor 32, and the electrical load sensor 34 and known or set data from an operator and controls operation of the refrigeration system 17, blower 18, and damper 20 as a function of this data as discussed in more detail below. The controller 36 may be wired to the air conditioner 14 and sensors 30, 32, 34 or may communicate with and/or control these devices wirelessly through wireless communication channels.

The controller 36 may be implemented in hardware, software, firmware, or a combination thereof and may include any number of processors, controllers, microprocessors, microcontrollers, programmable logic controllers (PLCs), field-programmable gate arrays (FPGAs), application specific integrated circuits (ASICs), or any other component or components that are operable to perform, or assist in the performance of, the operations disclosed herein. In one embodiment, the controller 36 is implemented with a PLC with analog input and output modules.

An embodiment of the controller 36 also includes a user interface such as a touchscreen display, keypad, control buttons or other devices that permit an operator to input data and/or instructions such as an inside temperature setpoint or control program. The controller 36 may also include memory elements for storing instructions or data. The memory elements may be a single component or may be a combination of components that provide the requisite functionality. The memory elements may include various types of volatile or non-volatile memory such as flash memory, optical discs, magnetic storage devices, SRAM, DRAM, or other memory devices capable of storing data and instructions. The memory elements may communicate directly with the controller, or they may communicate with the controller over a data bus or other mechanism.

The controller 36 may implement one or more computer programs that perform functions described herein. The computer programs may comprise ordered listings of executable instructions for implementing logical functions in the controller 36. The computer programs can be embodied in any computer-readable medium for use by or in connection with an instruction execution system, apparatus, or device, such as a computer-based system, processor-containing system, or other system that can fetch the instructions from the instruction execution system, apparatus, or device, and execute the instructions. In the context of this application, a "computer-readable medium" can be any means that can contain, store, communicate, propagate or transport the program for use by or in connection with the instruction execution system, apparatus, or device. The computer-readable medium can be, for example, but not limited to, an electronic, magnetic, optical, electro-magnetic, infrared, or semi-conductor system, apparatus, device, or propagation medium. More specific, although not inclusive, examples of the computer-readable medium would include the following: an electrical connection having one or more wires, a portable computer diskette, a random access memory (RAM), a read-only memory (ROM), an erasable, programmable, read-only memory (EPROM or Flash memory), an optical fiber, and a portable compact disk read-only memory (CDROM).

Figure 2:
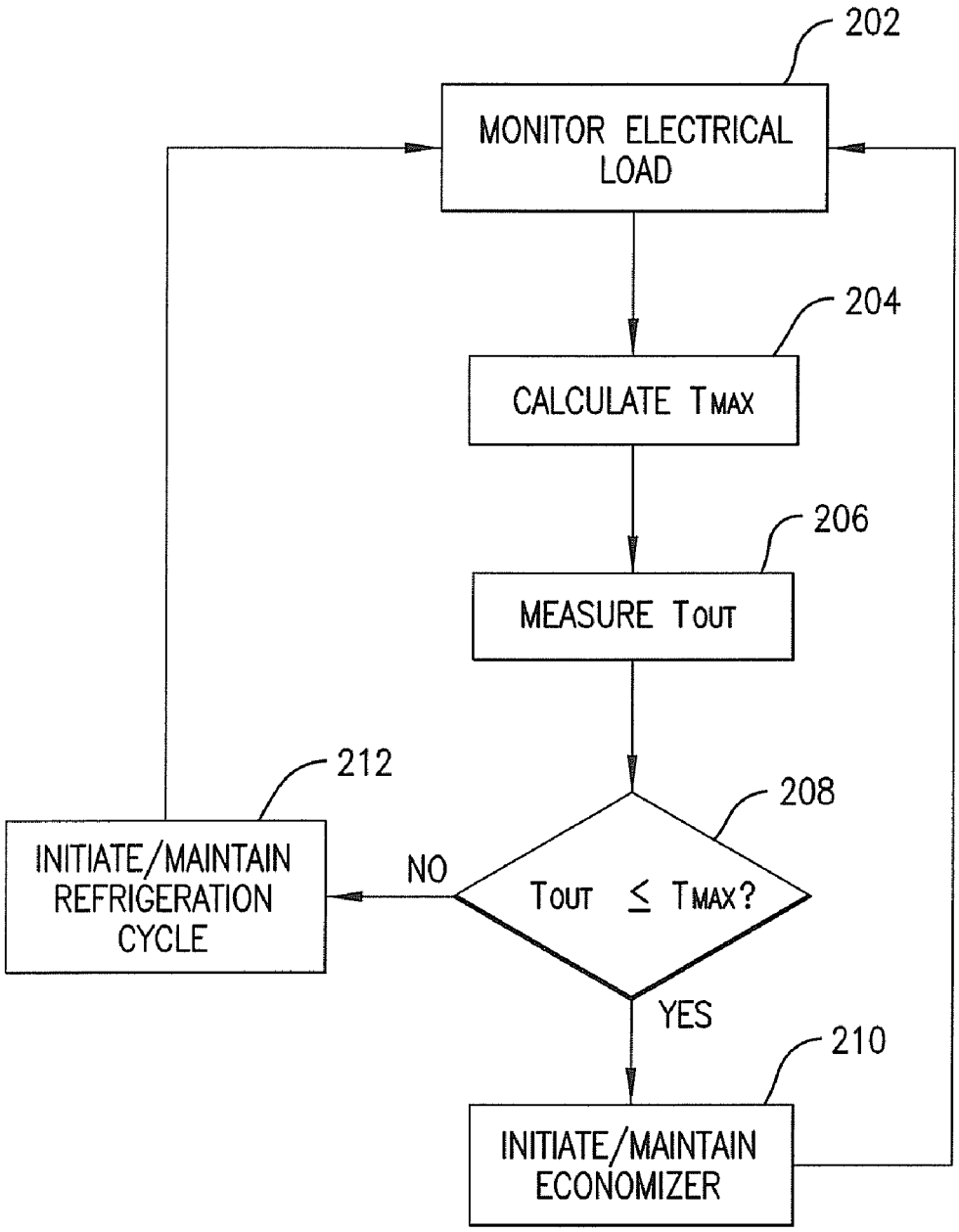
FIG. 2 is a flow diagram depicting exemplary steps in a method of the invention and/or exemplary module segments or code segments of a computer program of the invention.
Figure 3:
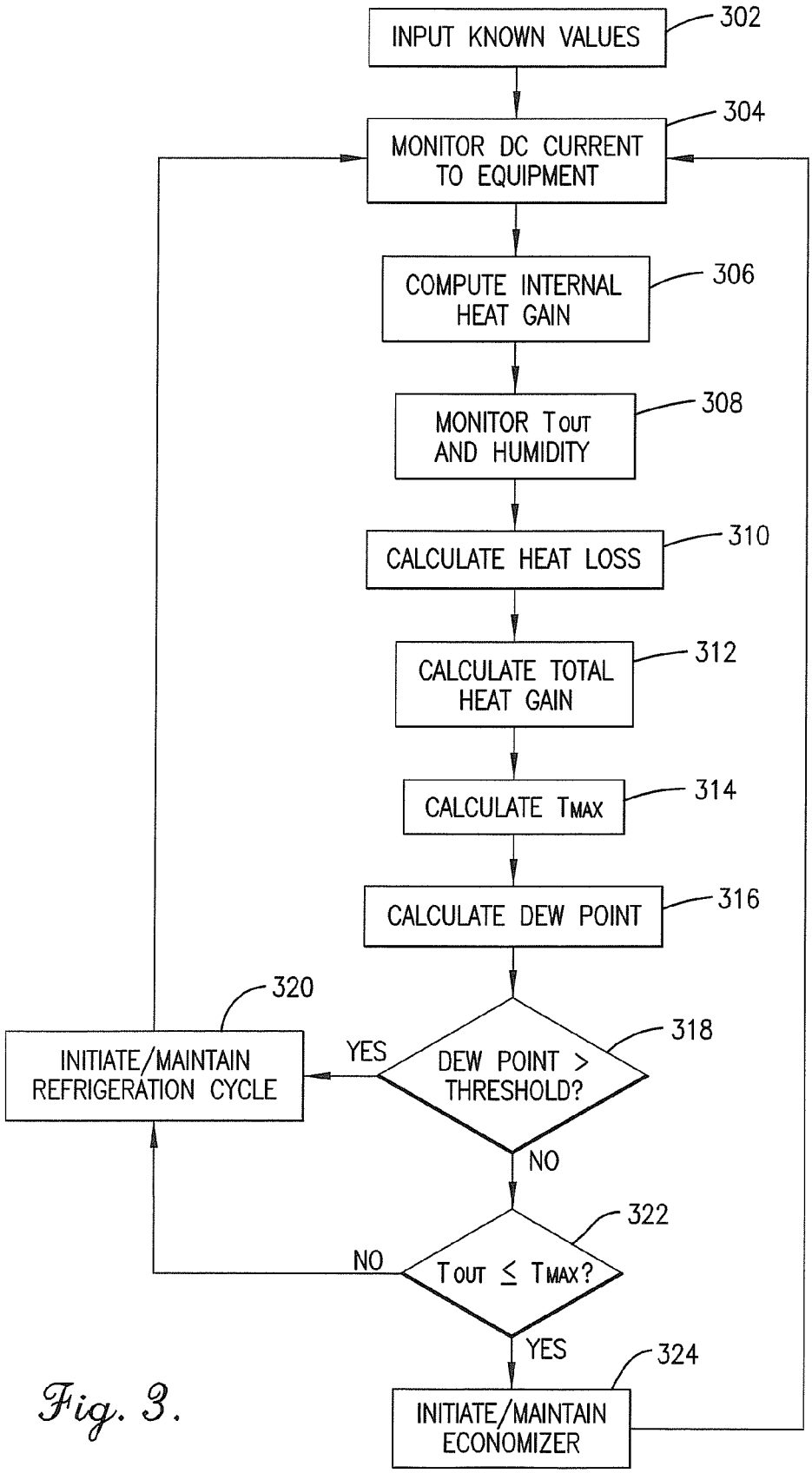
FIG. 3 is another flow diagram depicting exemplary steps in a method of the invention and/or exemplary module segments or code segments of a computer program of the invention.

The flow charts of FIGS. 2 and 3 show the functionality and operation of exemplary implementations of the present invention in more detail. In this regard, some of the blocks of the flow charts may represent method steps and/or a module segment or portion of code of computer programs, each of which comprises one or more executable instructions for implementing the specified logical function or functions. In some alternative implementations, the functions noted in the various blocks may occur out of the order depicted in FIGS. 2 and 3. For example, two blocks shown in succession in FIG. 2 or 3 may in fact be executed substantially concurrently, or the blocks may sometimes be executed in the reverse order depending upon the functionality involved.

FIG. 2 depicts a general or high-level embodiment of the invention. After certain known or set data is entered into the controller 36, the controller 36 monitors the current electrical load of the equipment 38 in the enclosure 12 as depicted in block 202. The controller then calculates a maximum acceptable outdoor temperature (Tmax) at which the air conditioner's economizer cycle may be operated based at least partially on the electrical load as depicted in block 204. The controller 36 also measures or monitors an actual outdoor temperature (Tout) as depicted in block 206. The controller 36 then determines if Tout is less than or equal to Tmax in block 208 and initiates or maintains an economizer cycle of the air conditioner 14 in block 210 if it is and initiates or maintains the refrigeration cycle of the air conditioner 14 in block 212 if it is not.

FIG. 3 depicts more detailed embodiments of the invention. Initially, selected known or set values are input in the controller 36 as depicted in step 302. For example, using the keypad or other user interface of the controller, an operator may input an indoor setpoint temperature for the enclosure 12 (e.g. 75.degree. F.) This is the temperature the operator wishes to maintain in the enclosure 12. The operator may also input a building heat loss constant K that accounts for the amount of heat loss from or heat gain into the enclosure 12. The heat loss constant K is measured in btu/.degree. F. and varies from enclosure to enclosure largely based on the amount of insulation in the walls and ceiling of the enclosure and the size of the enclosure. The operator may also input the air flow rate of the blower 18 measured in cubic feet/minute (CFM) and the voltage rating of the electrical equipment 38 measured in voltage (e.g. 24 VDC). Finally, the operator may enter a maximum outside dew point at which the economizer cycle may be operated. This dew point threshold allows the owner/operator of the electrical equipment 38 to control the amount of moisture that may be introduced in the enclosure 12. For example, if the equipment owner wishes to maintain very low humidity in the enclosure, a low dew point threshold (e.g. 50.degree. F.) may be selected to ensure that the economizer cycle is only operated when the outdoor air is relatively dry.

Once the above data has been input into the controller 36, the controller 36 may begin controlling operation of the air conditioner 14. As with the embodiments of FIG. 2, the controller 36 monitors the current electrical load of the equipment 38 as depicted in block 304. This may be done by receiving a proportional signal from the load sensor 34 or otherwise sensing or monitoring the DC current used to power the equipment 38.

The controller 36 then calculates the internal heat gain in the enclosure 12 in block 306. For enclosures not typically occupied by people, this may be done by multiplying the sensed DC current by the known power supply voltage and by a factor of 3.413 to convert to btu/hr.

The controller 36 also monitors the outdoor temperature, relative humidity, and possibly dew point as depicted in block 308. This may be done by polling or otherwise receiving temperature, humidity, and dew point data from the temperature and humidity sensor 30 or another source.

The controller 36 then calculates the heat loss from the enclosure 12 (or heat gain to the enclosure 12) as depicted in block 310. In one embodiment, this is done by calculating the temperature difference between the measured outdoor temperature and the inside setpoint temperature and multiplying this value by the constant K.

The controller 36 next calculates the total sensible heat gain for the enclosure in block 312 by subtracting the heat loss calculated in block 310 from the heat gain calculated in block 306.

The controller 36 then calculates the maximum outdoor air temperature (Tmax) capable of satisfying the cooling requirements of the enclosure 12 while in the economizer cycle as depicted in block 314. As explained in more detail below, Tmax takes into account the indoor temperature setpoint Tin or the actual measured indoor temperature, the total enclosure heat gain calculated in block 312 above, the entered CFM rating of the blower 18, and a conversion factor or constant. Tmax may also take into account the actual measured indoor temperature rather than the indoor temperature setpoint.

The controller 36 then calculates the actual outside air dew point temperature in block 316 using a formula described below. The controller 36 then determines if the dew point temperature is above an input threshold value in block 318. If it is, the controller 36 initiates or maintains the air conditioner's refrigeration cycle in block 320 and prohibits the economizer cycle.

If the outside dew point temperature is at or below the threshold, block 322 determines if the outdoor temperature Tout is less than or equal to Tmax. If it is, the controller 36 initiates or maintains the economizer cycle in block 324. If Tout is greater than Tmax, the controller 36 initiates or maintains the refrigeration cycle in block 320.

While the air conditioner 14 is being operated in its economizer cycle, the controller 36 uses Tmax as a setpoint for mixing the outside air and return air. In other words, the controller 36 adjusts the position of the damper 20 so that the temperature of the air supplied to the blower 18 is approximately equal to Tmax. This prevents overcooling of the enclosure 12 and keeps the on-off cycles of the blower 18 to a minimum. If the cooling load is satisfied, (as measured by the interior temperature sensor 32 or other temperature sensor), the controller 36 closes the damper 20 to prevent more outside air from entering the blower 18 and overcooling the enclosure 12.

The following is an example of the above-described methods for certain known and measured values:

Known or Set Values

Indoor Set Temperature (Tin)=75° F.

Building Heat Loss Constant (K)=68.7 btu/° F.

Blower Air Flow Rate=2000 CFM

Equipment Voltage (Volts)=24 VDC

Maximum Outside Dew Point (customer supplied)=60° F.

Measured Values

Outdoor Temperature (Tout)=40° F.

Outside Relative Humidity (RH)=92%

Equipment Current (Amps)=451.2 DC amps

Calculations Internal Heat Gain (IHG)=Volts×Amps×3.413 [btu/hr]

IHG=24 volts×451.2 amps×3.413=36958.7 btu/hr

Heat Loss Through Structure (HLS)=(Tin−Tout)×K [btu/hr]

HLS=(75° F.-40° F.)×68.57 btu/° F.=2400 btu/hr

Total Heat Gain (THG)=−HLS [btu/hr]

THG=36958.7 btu/hr−2400 btu/hr=34558.7 btu/hr

Maximum Acceptable Outdoor Temperature for Economizer Cooling $(T\text{max})=T\text{in}-(\text{THG}/\text{CFM}/1.08)$ [° F.]

$T\text{max}=75°\text{ F.}-(34558.7\text{ btu/hr}/2000\text{ cfm}/1.08)=59°\text{ F.}$ Dew point (Td) in degrees Celsius may be calculated to within ±0.4° C. with the formula below, which is valid for:

$0°\text{ C.}<T<100°\text{ C.}$ $0.01<\text{RH}<1.0$ $0°\text{ C.}<T_d<50°\text{ C.}$ where T=temperature in degrees Celsius RH=relative humidity as a fraction (not percent)

$$T_d = \frac{b\gamma(T, RH)}{a - \gamma(T, RH)}$$

where $$\gamma(T, RH) = \frac{aT}{b+T} + \ln RH$$

and a=17.27 b=237.7° C.

Using this formula and the known and measured values above, $T_d$ equals 37.9° F.

In this example, the controller 36 initiates the economizer cycle, or maintains its operation, because the calculated $T_d$ is below the maximum outside dew point specified by the operator and Tout is less than Tmax.

Figure 4:
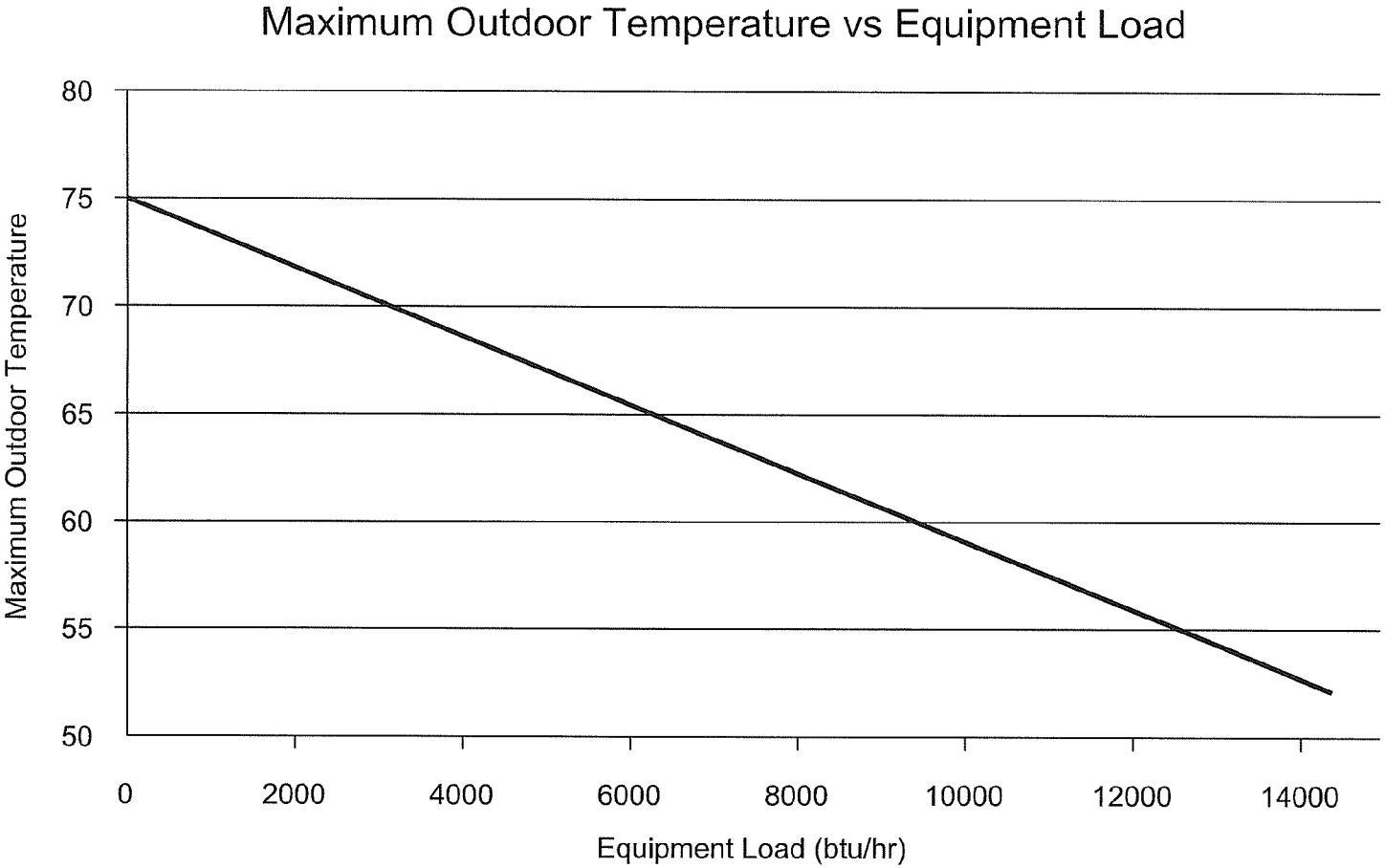
FIG. 4 is a graph depicting the maximum outdoor temperature at which the economizer cycle of an air conditioner may be operated versus the electrical level of equipment in an enclosure served by the air conditioner when using the principles of the present technology.

An important advantage of the present technology is illustrated in FIG. 4, which is a graph of the maximum acceptable outdoor temperature Tmax versus equipment load for an exemplary air conditioner 14 and enclosure 12 where the air conditioner temperature set point is 75.degree. F. As depicted, economizer operation can take place at a higher outside temperature as the internal equipment load decreases, assuming the dew point threshold is not exceeded. In other words, warmer air will provide adequate cooling with a reduced load. Since the control system 16 of the present invention continually monitors equipment load and updates Tmax, the hours of economizer operation can be maximized. In contrast, prior art systems typically only initiate their economizer cycles at much lower outside temperatures or require more sophisticated sensing of the enthalpy of both the outside air and the return air.

Although the invention has been described with reference to the preferred embodiment illustrated in the attached drawing figures, it is noted that equivalents may be employed and substitutions made herein without departing from the scope of the invention as recited in the claims. For example, although the above description and accompanying drawing figures describe and illustrate a vapor compression-type air conditioning system, the principles of the present invention also apply to other types of air conditioning systems including thermoelectric, adsorption, and absorption systems.

Having thus described the preferred embodiment of the invention, what is claimed as new and desired to be protected by Letters Patent includes the following:

1. An air conditioning system for cooling an enclosure, the air conditioning system comprising:

an air conditioner comprising: a refrigeration system including an evaporator coil, a condenser coil, and a compressor; a blower for blowing air over the evaporator coil and into the enclosure; and a damper for controlling an amount of outside air and return air provided to the blower; and a controller for controlling operation of the air conditioner, the controller operable to: monitor an electrical load of equipment in the enclosure; calculate a maximum acceptable outdoor temperature at which an economizer cycle of the air conditioner may be operated based at least partially on the electrical load; receive data representative of an actual outdoor temperature; initiate the economizer cycle if the actual outdoor temperature is equal to or below the maximum acceptable outdoor temperature; and modulate the damper to maintain a selected mix of outside air and return air provided to the blower in order to maintain a desired temperature in the enclosure while the air conditioner is in the economizer cycle, wherein the controller determines the selected mix of outside air and return air based on the maximum acceptable outdoor temperature and the actual outdoor temperature.

2. The air conditioning system as set forth in claim 1, wherein the controller monitors the electrical load by receiving data representative of a current value drawn by the electrical equipment and multiplying the current value by a known voltage rating of the electrical equipment.

3. An air conditioning system for cooling an enclosure, the air conditioning system comprising:

an air conditioner; and a controller for controlling operation of the air conditioner, the controller operable to: monitor an electrical load of equipment in the enclosure by receiving data representative of a current value drawn by the electrical equipment and multiplying the current value by a known voltage rating of the electrical equipment; calculate a maximum acceptable outdoor temperature at which an economizer cycle of the air conditioner may be operated based at least partially on the electrical load; receive data representative of an actual outdoor temperature; and initiate the economizer cycle if the actual outdoor temperature is equal to or below the maximum acceptable outdoor temperature, wherein the controller is further operable to calculate an internal heat gain value of the enclosure by multiplying the electrical load by a known constant.

4. The air conditioning system as set forth in claim 3, wherein the controller is further operable to receive data representative of a set point temperature for the enclosure and to calculate a heat loss value of the enclosure based on the set point temperature and the actual outdoor temperature.

5. The air conditioning system as set forth in claim 4, wherein the controller is further operable to calculate a total sensible heat gain value for the enclosure based on the internal heat gain value and the heat loss value.

6. The air conditioning system as set forth in claim 5, wherein the air conditioner comprises:

a refrigeration system including an evaporator coil, a condenser coil, and a compressor;

a blower for blowing air over the evaporator coil and into the enclosure; and a damper for controlling an amount of outside air and return air provided to the blower, wherein the controller is further operable to calculate the maximum outdoor temperature based on the set point temperature, the total sensible heat gain value, and an air flow rate of the blower.

7. The air conditioning system as set forth in claim 3, wherein the enclosure is a cabinet, a shed, a building, or a room of a building.

8. A method of operating an air conditioner system that serves an enclosure, the method comprising:

monitoring an electrical load of equipment in the enclosure by monitoring a DC current value drawn by the equipment and multiplying the DC current value by a known voltage rating of the equipment to determine the electrical load;

multiplying the electrical load by a constant to calculate an internal heat gain value of the enclosure;

calculating a maximum acceptable outdoor temperature at which an economizer cycle of the air conditioner system may be operated based at least partially on the electrical load;

monitoring an actual outdoor temperature; and initiating an economizer cycle of the air conditioner system if the actual outdoor temperature is equal to or below the maximum acceptable outdoor temperature.

9. The method as set forth in claim 8, further comprising receiving data representative of a set point temperature for the enclosure and calculating a heat loss value of the enclosure based on the set point temperature and the actual outdoor temperature.

10. The method as set forth in claim 9, further comprising calculating a total sensible heat gain value for the enclosure based on the internal heat gain value and the heat loss value.

11. The method as set forth in claim 10, wherein the air conditioner system includes:

a refrigeration system including an evaporator coil, a condenser coil, and a compressor;

a blower for blowing air over the evaporator coil and into the enclosure; and a damper for controlling an amount of outside air and return air provided to the blower, and further comprising calculating the maximum acceptable outdoor temperature based on the set point temperature, the total sensible heat gain value, and an air flow rate of the blower.

12. A non-transitory computer-readable storage medium with an executable program stored thereon for directing a control system of an air conditioner to perform the following steps:

monitor an electrical load of equipment in an enclosure served by the air conditioner;

monitor a DC current value drawn by the equipment and multiply the DC current value by a known voltage rating of the equipment to determine the electrical load;

multiply the electrical load by a constant to calculate an internal heat gain value of the enclosure;

calculate a maximum acceptable outdoor temperature at which an economizer cycle of the air conditioner may be operated based at least partially on the electrical load;

monitor an actual outdoor temperature; and initiate the economizer cycle if the actual outdoor temperature is equal to or below the maximum acceptable outdoor temperature.

13. The non-transitory computer-readable storage medium of claim 12, wherein the executable program further directs the control system to receive data representative of a set point temperature for the enclosure and calculate a heat loss value of the enclosure based on the set point temperature and the actual outdoor temperature.

14. The non-transitory computer-readable storage medium of claim 13, wherein the executable program further directs the control system to calculate a total sensible heat gain value for the enclosure based on the internal heat gain value and the heat loss value.

15. The non-transitory computer-readable storage medium of claim 14, wherein the air conditioner includes:

a refrigeration system including an evaporator coil, a condenser coil, and a compressor;

a blower for blowing air over the evaporator coil and into the enclosure; and a damper for controlling an amount of outside air and return air provided to the blower, wherein the executable program further directs the control system to calculate the maximum acceptable outdoor temperature based on the set point temperature, the total sensible heat gain value, and an air flow rate of the blower.

16. An air conditioning system for cooling an enclosure housing telecommunications equipment, the air conditioning system comprising:

an air conditioner having a refrigeration system, said air conditioner being operable in a refrigeration cycle in which the refrigeration system is turned on and in an economizer cycle in which the refrigeration system is turned off; and a controller for controlling operation of the air conditioner, the controller being operable to monitor an electrical load of the telecommunications equipment in the enclosure; calculate a maximum acceptable outdoor temperature at which the economizer cycle of the air conditioner may be operated based at least partially on the electrical load of the telecommunications equipment; receive data representative of an actual outdoor temperature; and initiate the economizer cycle if the actual outdoor temperature is equal to or below the maximum acceptable outdoor temperature and initiate the refrigeration cycle if the actual outdoor temperature is above the maximum acceptable outdoor temperature.

17. The air conditioning system as set forth in claim 16, wherein the controller monitors the electrical load by receiving data representative of a current value drawn by the electrical equipment and multiplying the current value by a known voltage rating of the electrical equipment.

18. The air conditioning system as set forth in claim 17, wherein the controller is further operable to calculate an internal heat gain value of the enclosure by multiplying the electrical load by a known constant.

* * * * *